US005114009A

United States Patent [19]

Johnston

[11] Patent Number: 5,114,009

[45] Date of Patent: May 19, 1992

[54] ROAD-MAP HOLDER AND ORGANIZER

[76] Inventor: Ronald C. Johnston, 115 David Way, Grass Valley, Calif. 95949

[21] Appl. No.: 691,744

[22] Filed: Apr. 26, 1991

[51] Int. Cl.[5] ..... B65D 85/00; A45C 11/00

[52] U.S. Cl. ..... 206/425; 206/472; 206/494; 281/31; 281/51

[58] Field of Search ..... 40/159, 904; 150/147, 150/154; 206/215, 232, 424, 425, 449, 450, 472, 494; 281/3.1, 4, 17, 20, 22, 26, 31, 34, 38, 40, 45, 46, 51

[56] References Cited

U.S. PATENT DOCUMENTS

| | | | |
|---|---|---|---|
| 2,539,286 | 1/1951 | Thompson | 40/904 |
| 2,828,975 | 4/1958 | Wright | 281/31 |
| 3,428,104 | 2/1969 | Ary | 206/425 |
| 3,446,260 | 5/1969 | Osher | 40/159 |
| 3,555,713 | 1/1971 | Leinbach | 40/159 |
| 3,734,155 | 5/1973 | Stenger | 206/425 |
| 4,004,690 | 1/1977 | Giarritta | 150/147 |
| 4,516,871 | 5/1985 | Leitman | 281/46 |
| 4,629,349 | 12/1986 | Pitts | 281/31 |
| 4,965,948 | 10/1990 | Ruebens | 40/159 |
| 4,974,983 | 12/1990 | Givati | 281/31 |

FOREIGN PATENT DOCUMENTS

| | | | |
|---|---|---|---|
| 2359422 | 6/1975 | Fed. Rep. of Germany | 40/159 |
| 2471638 | 6/1981 | France | 40/904 |
| 2592837 | 7/1987 | France | 281/22 |
| 0107463 | 7/1917 | United Kingdom | 206/472 |

*Primary Examiner*—Jimmy G. Foster

[57] ABSTRACT

A transparent pocket, sized to hold a folded road map, is mounted onto a leaf. A road-map holder consists of a plurality of these leaves welded together along a common, longitudinal axis. To search for a map, the user simply turns leaves until the sought-for map comes into view. Portions of each leaf not covered by a pocket are called margins. Margins play a key role in enabling the user to insert maps into, and extract maps from, their pockets. A road-map holder enclosed within a jacket having auxiliary pockets is called an organizer. Auxiliary pockets are for storing service receipts, warranties, maintenance logbook, owner's manual, proof-of-insurance, and vehicle registration.

13 Claims, 6 Drawing Sheets

ROAD-MAP HOLDER AND ORGANIZER

FIELD OF INVENTION

My invention pertains to paper holders generally, and more specifically to a novel way of holding folded road maps and other vehicle-related papers.

BACKGROUND OF INVENTION

Vehicle-related records and documents which are stored in gloveboxes are often strewn about, and road maps are typically torn or tattered which reduces, thereby, their useful lifespan. Not only is such disorganization frustrating when trying to retrieve a particular item from a glovebox. but torn and tattered maps confound attempts to read or fold them. Further, poor organization and the lack of compactness resulting therefrom, unduly restricts the number of items which could otherwise be stored in the tight confines of a vehicle's glovebox.

Although my invention is a useful glovebox accessory, the installation of passenger-side airbags requires that the traditional glovebox be eliminated. This situation creates a problem which was unforseen only a few years ago, namely, where to store a vehicle's road maps and other vehicle-related documents. My invention anticipates this problem and provides a solution.

Heretofore, no glovebox organizer has completely nor effectively solved the problem of road-map storage. One such organizer is comprised of shelves which adjusts to fit into gloveboxes of varying sizes. Retrieving maps from such a container is awkward and time consuming since maps cannot be individually seen prior to removal.

Another glovebox organizer now on the market consists of a folder which has pockets to store road maps and vehicle records. A major deficiency of this product is that it does not incorporate any specialized features which facilitates map retrieval. When using this product, the user places all maps into the same transparent pocket, making only the outside map visible to the user. To retrieve a particular map, the user either removes all maps at once or else removes them one at a time until the desired map comes into view. Removed maps are then returned to the same pocket. It is apparent that this design requires extensive map handling and is inconvenient to the user. Furthermore, the use of a single pocket to store more than one map accelerates map degeneration.

Another product, designed exclusively to hold road maps, comprises an opaque plastic folder having a series of panels which unfold. On the inside of the folder, transparent plastic pockets are aligned with and attached to each panel. A road map may be inserted into each pocket. With this design, the user unfolds panel after panel until the sought-for map comes into view. Drawbacks to this design are: 1) for each use, the user must take the time to fold and unfold a folder which may have up to six or more panels, 2) the numerous panels create excessive bulk, and 3) the folded-out length is awkward to work with.

SUMMARY OF INVENTION

My invention entails three major embodiments: 1) a road-map holder, 2) an optional outer jacket, and 3) auxiliary pockets incorporated into said outer jacket for storing assorted vehicle-related papers. The road-map holder consists of specially designed, transparent pockets which are sized to hold and display folded road maps. Each pocket is affixed to a rectangular leaf. A plurality of leaves are welded together along a line defined by their longitudinal edge. This line defines a common axis (hereinafter called the pivot axis) around which leaves may be turned. When searching for a map, the user turns leaves (in a manner similar to turning pages in a book) until the sought-for map comes into view. Once located, the map is removed from its pocket, and unfolded. Once used, the map is refolded and returned to its pocket.

An outer jacket is optionally provided as an alternative embodiment. If provided, the road-map holder is hinged to the jacket's interior in a manner which preserves the pivot action of each leaf. Auxiliary pockets may be incorporated into the jacket for storing such vehicle-related papers as ownner's manual, repair receipts, warranties, maintenance logbook, proof-of-insurance and vehicle registration cards. The exact layout of auxiliary pockets can assume many forms. Whatever the layout, the major benefit of my invention is that, since leaves are hinged, map storage does not require the use of any portion of the jacket's limited surface area. The jacket's entire surface area is made available, thereby, for the exclusive use of auxiliary pockets. This novel feature enhances document accessibility without sacrificing storage capacity.

OBJECTS AND ADVANTAGES

An object of my invention is to provide a form of map holder which will protect road maps from becoming torn or tattered, extending, thereby, their useful lifetimes.

Another object is to provide the user with the advantage of being able to quickly and easily locate any desired road map from among a numerous collection of such maps.

The road-map holder can optionally be extended to include auxiliary pockets for storing an assortment of vehicle-related documents, such as service receipts, warranties, owner's manual, maintenance log, proof-of-insurance, and vehicle registration card.

For those who own a vehicle having a passenger-side airbag in lieu of a traditional glovebox, the invention offers an effective solution to the problem of where to store road maps and other vehicle-related papers.

A final object is that the invention be made from supple materials so as to better fit into a variety of vehicular compartments.

DRAWING FIGURES

FIG. 1: A road-map holder having three leaves. Leaves are welded together along the outer edge of their side margins, forming a pivot axis around which leaves may be turned. Each leaf has either one or two pockets. (Pockets and margins are shown in FIGS. 2 and 3.)

FIG. 2: Plan view of a leaf showing a full-size, transparent pocket affixed to its front side. Said pocket is welded together along three of four edges to form an envelope open along the top edge. Top and and side margins are also shown.

FIG. 3: Plan view of a leaf showing a transparent pocket affixed to its back side. Back pocket is a mirror image of the front pocket, with opening at the top.

FIG. 4: The road-map holder of FIG. 1 or FIG. 12 affixed to the inside of the jacket shown in FIG. 6.

FIG. 5: The road-map holder of FIG. 1 or FIG. 12 affixed to the inside of the jacket shown in FIG. 7.

FIG. 6: Interior view of a jacket having two panels.

FIG. 7: Interior view of a jacket having three panels.

FIG. 8: The jacket shown in FIG. 6, further comprising two auxiliary pockets, one of which encompasses the inside front panel and the other of which encompasses the inside back panel. Each pocket has an opening along the longitudinal side closest to the jacket's center.

FIG. 9: The jacket shown in FIG. 7, further comprising two auxiliary pockets, one of which encompasses the inside front panel and the other of which encompasses the inside back panel. Each pocket has an opening along the longitudinal side closest to the jacket's center.

FIG. 10: The jacket shown in FIG. 8, further comprising two transparent, half-size pockets which are mounted, piggy-back style, onto that auxiliary pocket which encompasses the front panel.

FIG. 11: The jacket shown in FIG. 9, further comprising two transparent, half-size pocket which are mounted onto the middle panel.

FIG. 12: The road-map holder of FIG. 1, further comprising a flap welded to its pivot axis.

REFERENCE NUMERALS

1—A leaf
2*a*—Full-size transparent pocket mounted on front side of leaf
2*b*—Full-size transparent pocket mounted on back side of leaf
3—Pivot axis
4—Top margin
5—Side margin
6—Front panel of jacket, interior view
7—Back panel of jacket, interior view
8—Middle section of three-panel jacket
9—Spine of jacket
10*a*—Auxiliary pocket encompassing inside front panel
10*b*—Auxiliary pocket encompassing inside back panel
11*a*—Upper half-size transparent pocket
11*b*—Lower half-size transparent pocket
12—A flap.

DETAILED DESCRIPTION

Figure 1:
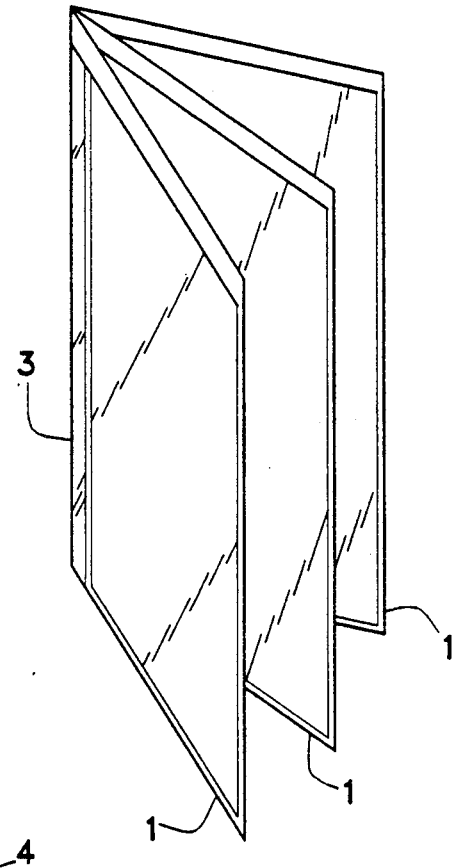

My invention comprises a specially-designed apparatus which holds vehicle-related papers. A key component of my invention is a road-map holder having arbitrarily many leaves, all welded together along a longitudinal edge. FIG. 1 shows a road-map holder having three identical leaves (1). To each leaf is affixed one or two elongated, transparent pockets, each sized to hold a folded road map. The edge along which leaves are welded defines an axis which is common to all leaves. I call this common axis the pivot axis (3). When searching for a map, the user turns leaves around the pivot axis, similar to turning pages in a book, until the sought-for map comes into view.

Figure 2:
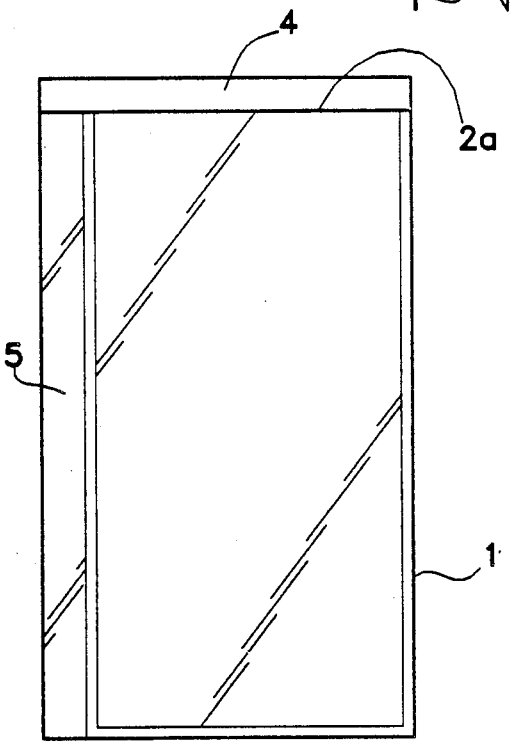
Figure 3:
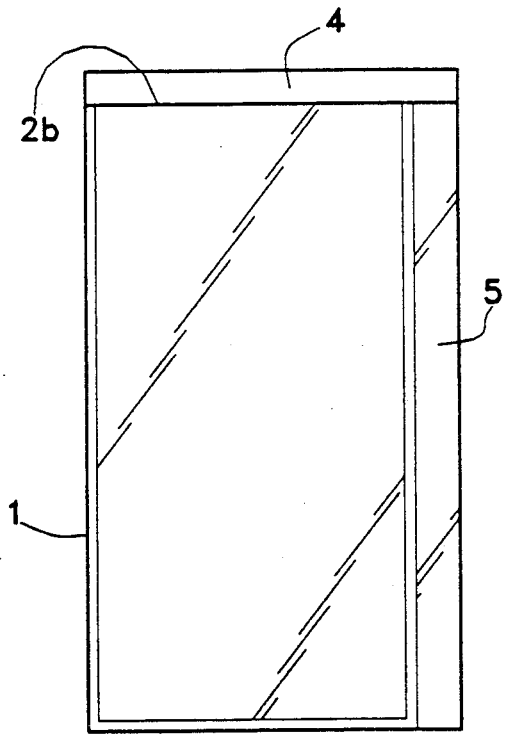

Transparent pockets are affixed to leaves as follows: facing the front side of a leaf, a front pocket (2*a*) is affixed to the leaf's lower right-hand side, as shown in FIG. 2. If a leaf has two pockets (the preferred embodiment), then the second pocket (2*b*) resides on the back side of the leaf, affixed to the leaf's lower left-hand side in a mirror-image orientation to the front pocket, as shown in FIG. 3. Thus, the three-leaf map-holder shown in FIG. 1 has a map-carring capacity of three or six road maps, depending on whether each leaf has one or two pockets. Pockets open at the top, as indicated by the lead lines emanating from reference numerals 2*a* and 2*b*. Pockets measure approximately four-and-one-half inches wide by nine-and-one-quarter inches high.

A margin is defined to be that portion of a leaf not covered by a pocket. As seen in FIGS. 2 and 3, each leaf has a top margin (4) and a side margin (5). The top margin is approximately one-half inch wide and provides a finger-hold area for use in guiding maps into and out of their pockets. A finger-hold area is provided since free-swinging, light-weight pockets tend to droop, and users would otherwise have difficulty inserting road maps into such pockets, especially since road maps tend to fan out at the bottom and their edges tend to become frayed.

The purpose of side margins is to provide distance between the pivot axis and pocketed road maps. Since pocketed road maps all funnel toward the same (pivot) axis, the bulk due to map thicknes results in maps being crimped along this axis. As a result, maps would otherwise stick or bind while being inserted into, or pulled from, their pocket. A side margin is provided, therefore, to displace map bulk from the immediate vicinity of the pivot axis. Moreover, a map holder carrying many maps requires a wider side margin than does a map holder carrying few maps. For example, in the case of a map holder having a carrying capacity of six road maps, I have determined that a side margin width of approximately three-eighths of an inch will insure that maps do not bind as they are being inserted into or removed from their pocket.

A road-map holder may, or may not, be enclosed within an outer jacket. If enclosed, auxiliary pockets may be incorporated into the outer jacket for use in storing a variety of vehicle-related papers. It is seen, therefore, that the major embodiments of this invention are 1) a road-map holder, 2) a road-map holder enclosed within a jacket, and 3) a road-map holder enclosed within a jacket having auxiliary pockets. The last embodiment will be called an organizer.

Figure 4:
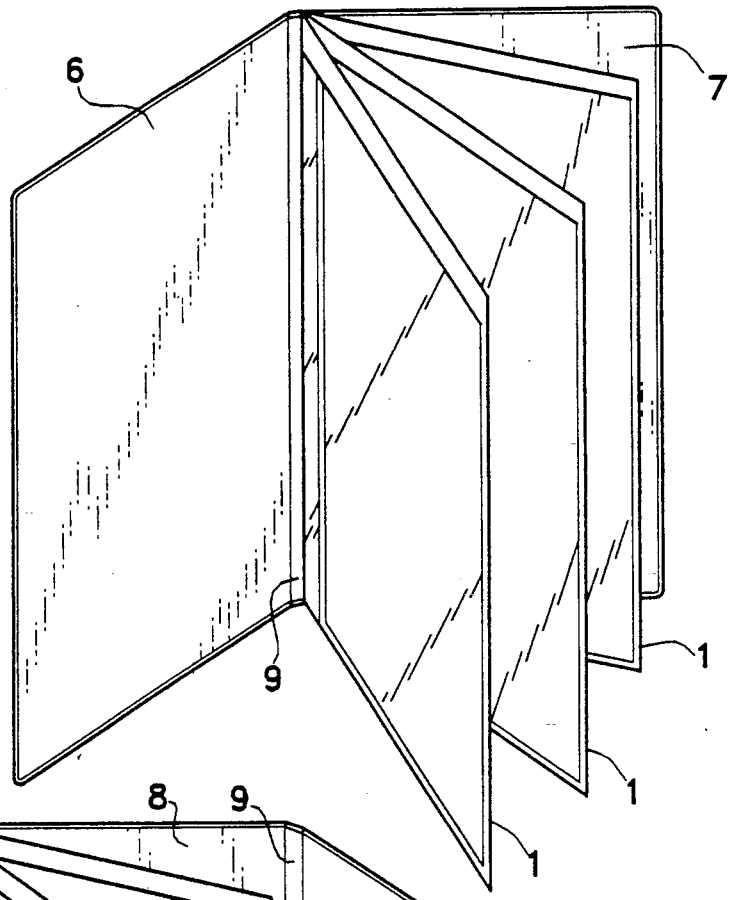
Figure 5:
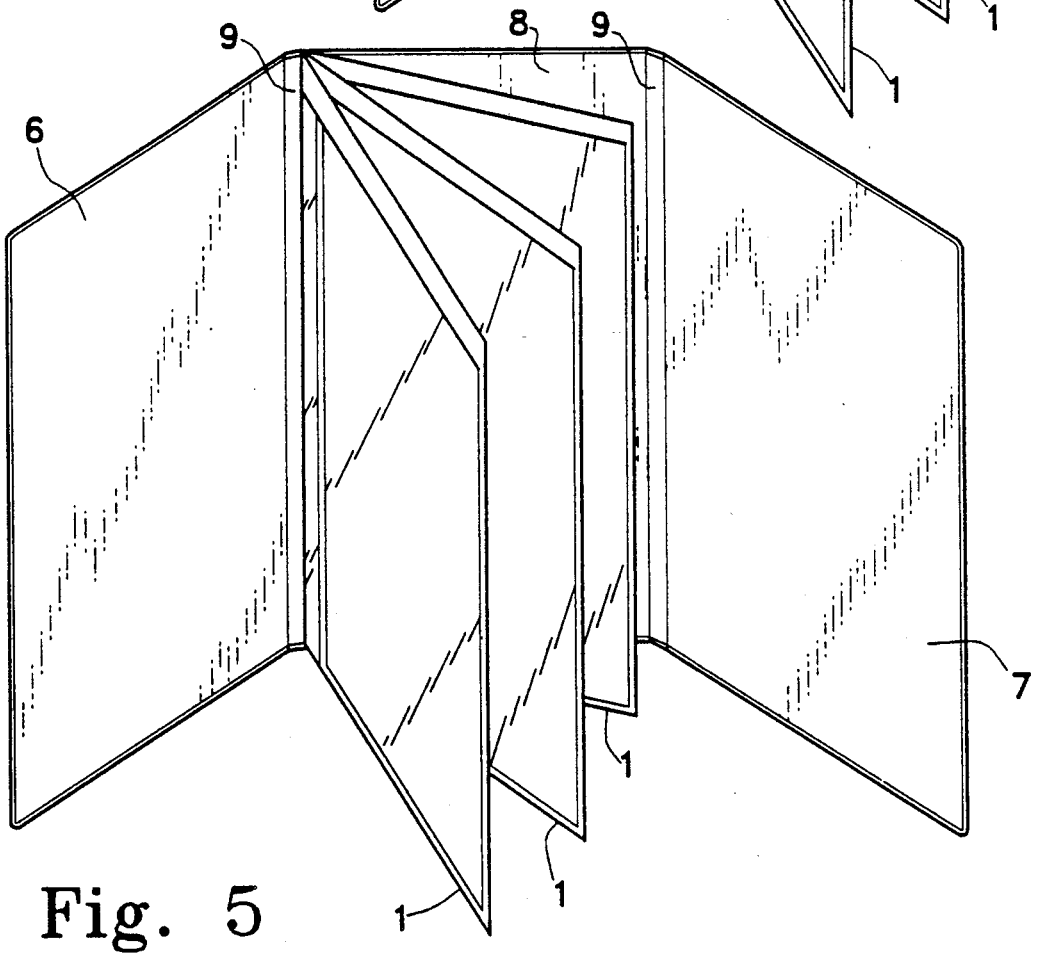
Figure 6:
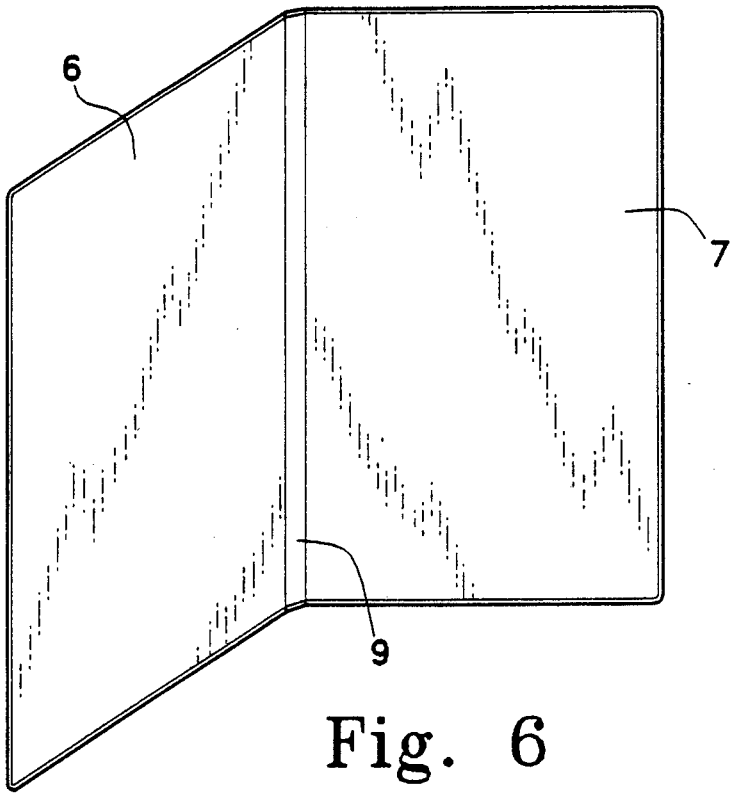

FIG. 4 illustrates the road-map holder of FIG. 1 enclosed within the two-panel jacket shown in FIG. 6. FIG. 5 illustrates the road-map holder of FIG. 1 enclosed within the three-panel jacket shown in FIG. 7. A two-panel jacket consists of two equally-sized sections, namely, a front panel (6) and a back panel (7). A three-panel jacket consists of three equally-sized sections: a front panel (6), a middle panel (8), and a back panel (7). In order to close a three-panel jacket, one first folds the back panel over the middle panel, and then folds the front panel over the back panel, resulting thereby in a folded dimension the size of one panel.

Between each pair of adjacent panels is a contiguous area that I call a spine (9), analogous to the spine of a book. Spine width determines the amount of bulk (i.e. number of maps, vehicle records, etc.) which can be stored inside a jacket.

Figure 7:
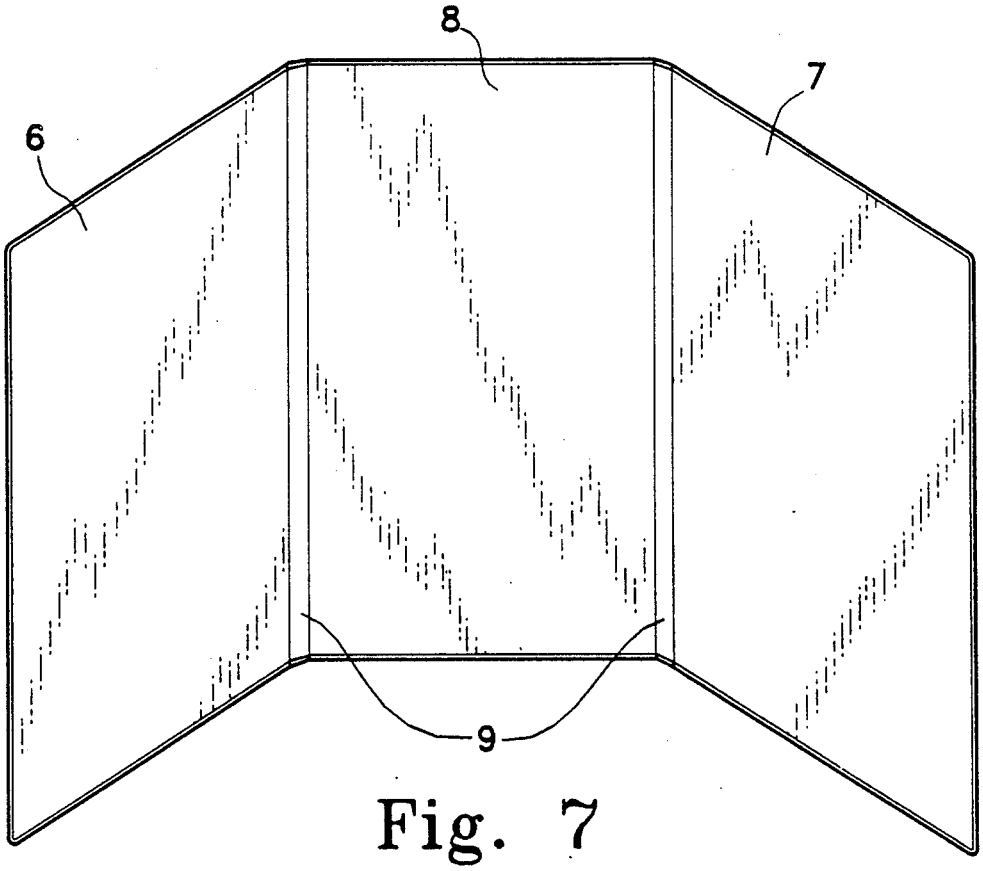
Figure 8:
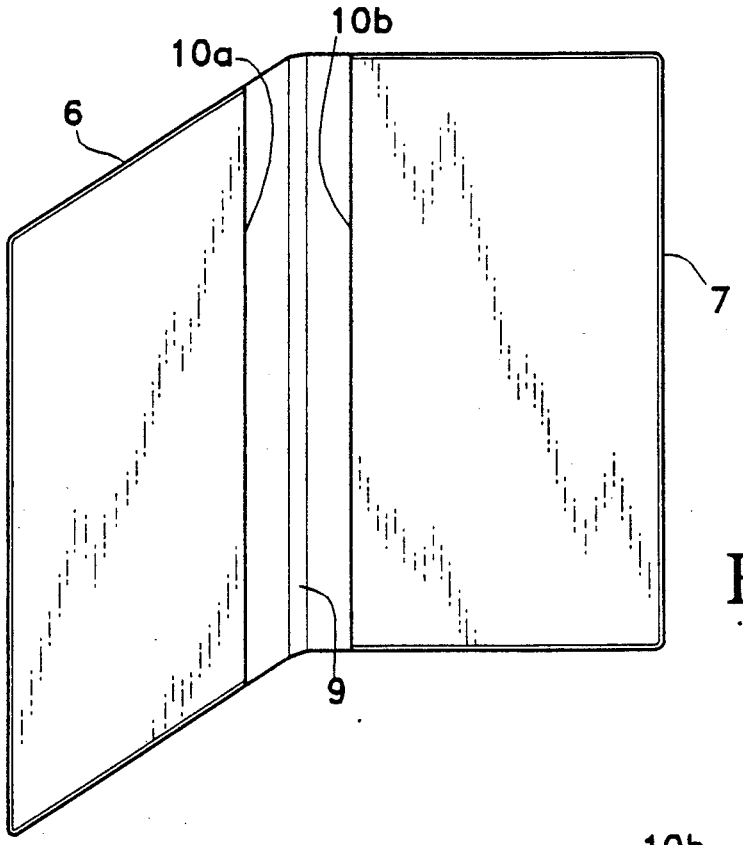
Figure 9:
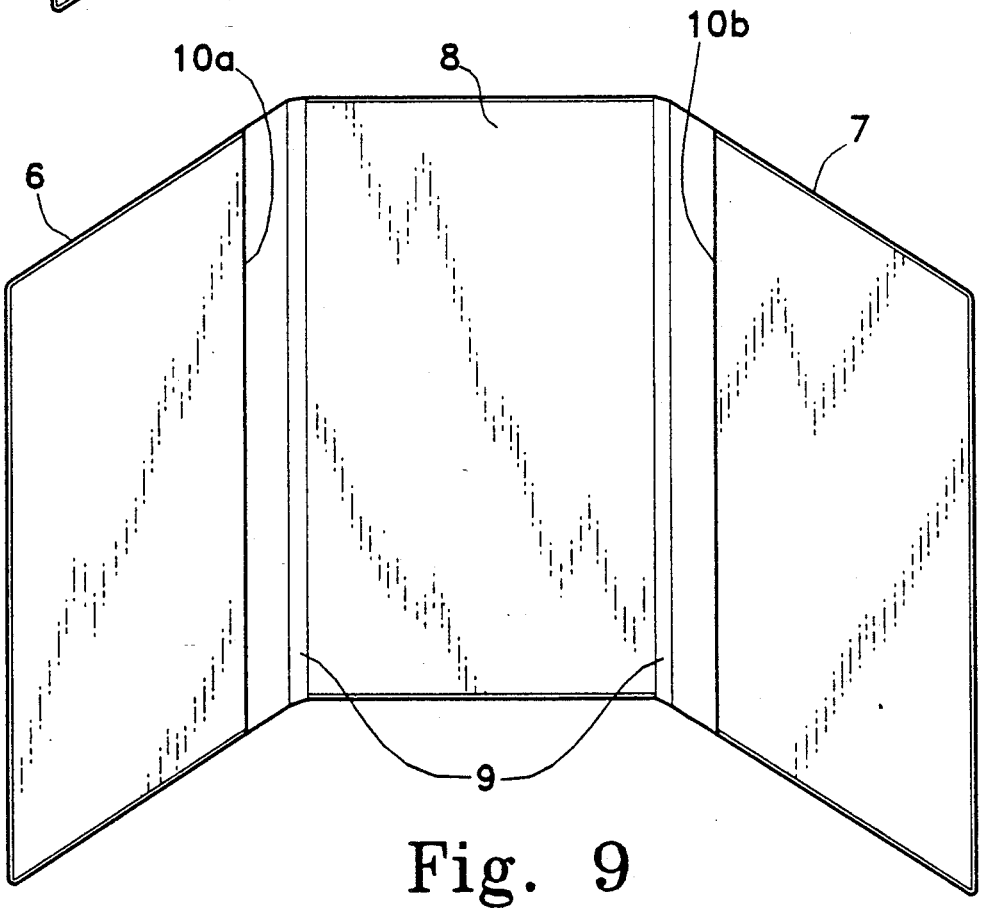

In order to hold an assortment of vehicle-related papers, auxiliary pockets may be incorporated into the jackets shown in FIGS. 6 and 7. Auxiliary pockets are shown in FIGS. 8 through 11. Each of these figures shows one auxiliary pocket encompassing the inside front panel (10*a*), and another encompassing the inside back panel (10*b*). Each pocket opens along that longitudinal edge which is closest to the jacket's center, as indicated by the lead lines emanating from reference numerals 10*a* and 10*b*. The front pocket (10*a*) may be used to keep vehicle service receipts and warranties. The back pocket (10*b*) may be used to keep a maintenance logbook and owner's manual.

Figure 10:
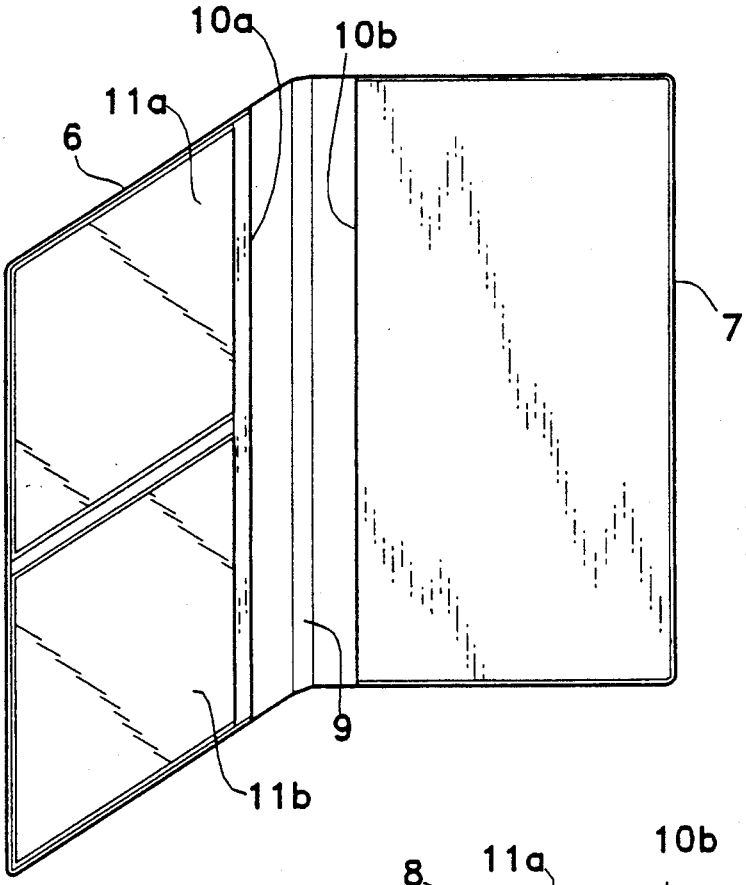
Figure 11:
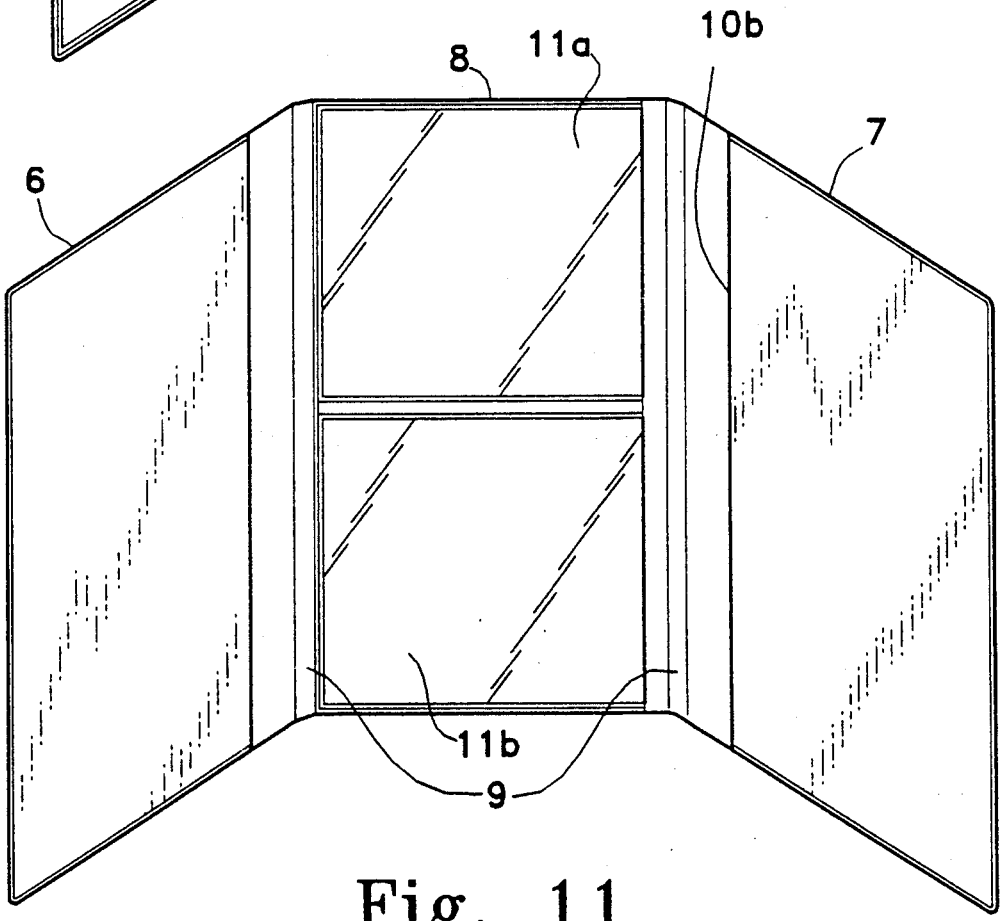

Vehicle registration and/or proof-of-insurance cards may be displayed using one or two half-size, transparent pockets. In FIG. 10, two half-size, transparent pockets (11*a*, 11*b*) are mounted, piggy-back style, onto the front pocket of the jacket shown in FIG. 8. In FIG. 11, two half-size, transparent pockets (11*a*, 11*b*) are affixed to the middle panel of the jacket shown in FIG. 9. For example, vehicle registration may be displayed in pocket 11*a*, and proof-of-insurance may be displayed in pocket 11*b*.

In order to affix a road-map holder to a jacket, as shown in FIGS. 4 and 5, two methods of attachment are considered in this invention. In the first method, the road-map holder's pivot axis is affixed directly (e.g. sewn, fused, welded, bonded, glued, etc.) to a jacket's spine, in the direction running with the spine. If a jacket should have more than one spine, then any spine suffices.

Figure 12:
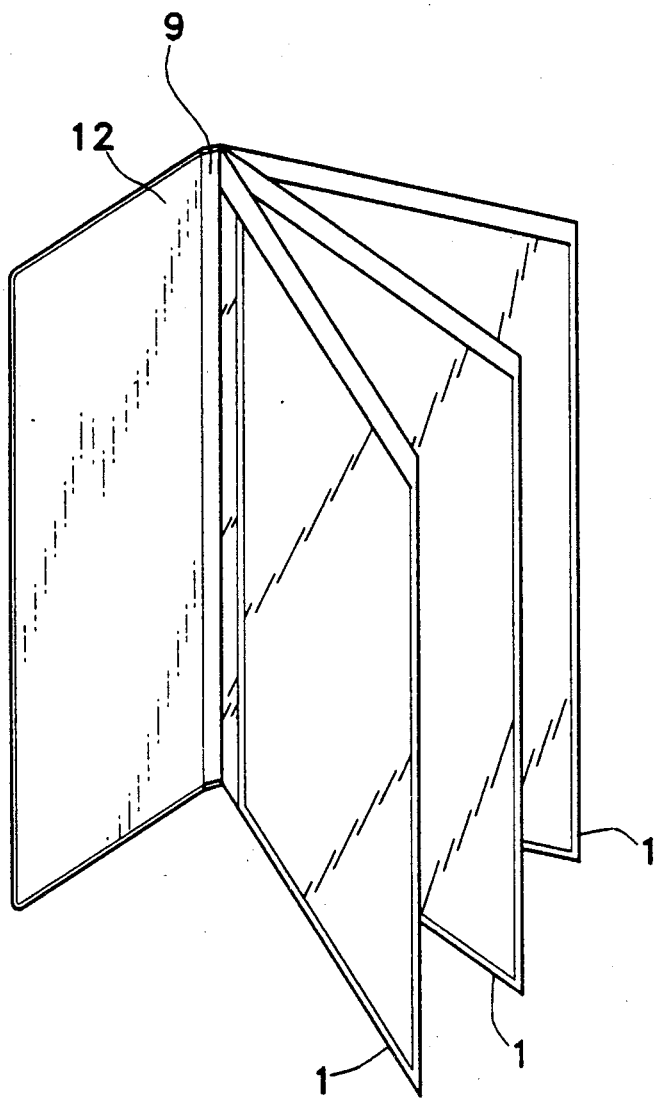

In the second method of attachment, a flap (12) is first affixed to the road-map holder's pivot axis, as shown in FIG. 12. This flap is then inserted into either of the jacket's interior pockets (10*a* or 10*b*), thereby securing the map holder to the jacket.

Whichever method of attachment is used, the resultant product appears as shown in FIGS. 4 and 5, wherein leaves appear hinged to, and emanate radially from, a spine.

One goal is that my invention be able to fit in and conform to as many different vehicular compartments as possible. To accommodate this need, it is desirable that all parts of the invention, including spines, be made of supple materials.

SCOPE OF INVENTION

The foregoing descriptions contain specific details which should not serve to place artificial limitations on the scope of this invention. For example, although the drawings show a road-map holder having three leaves, any number, in fact, may be used. Also, margin widths can vary in size with a corresponding change in functional performance. Pocket size could vary, especially in foreign countries where road maps may be sized differently from those commonly found in the United States. Moreover, whereas my illustrations show jackets having auxiliary pockets on both the front and back panels, a jacket could be manufactured having just one auxiliary pocket. In a similar vein, my drawings show two half-size transparent pockets, both of which are piggy-backed onto the front panel's auxiliary pocket. Obviously, these pockets can also be piggy-backed onto the back panel's auxiliary pocket. Or, one of these pockets could be piggy-backed onto the front, and the other onto the back, panel. These and other minor changes in pocket definition and positioning are intended to be within the scope and the spirit of this patent application.

I claim:

1. A road-map holder for holding folded road maps, comprising:

a) a plurality of planar pages;

b) each page consisting of a leaf and a first pocket;

c) each said leaf being substantially rectangular, said leaf having a first edge and a second edge, said first edge shorter than said second edge, said first edge substantially perpendicular to said second edge, said leaf having a front side and a back side;

d) a first marginal area, said first marginal area positioned on said leaf along said first edge;

e) a second marginal area, said second marginal area positioned on said leaf along said second edge;

f) said first pocket affixed to the front side of said leaf, said first pocket bordered by said first marginal area and said second marginal area, said first pocket being transparent, said first pocket sized to hold a folded road map, said first pocket having one opening, said opening being only along said first marginal area;

g) hinged means defined by the respective second edges of said pages being welded together along a common axis enabling said pages to pivot on said axis.

2. The road-map holder as recited in claim 1, further comprising a second pocket, said second pocket affixed to the back side of each said page, said second pocket bordered by said first marginal area and said second marginal area, said second pocket being transparent, said second pocket having one opening, said opening being along said first marginal area.

3. An enclosed road-map holder, comprising:

a) the road-map holder as recited in claim 1;

b) a jacket, said jacket having an exterior side and an interior side, said jacket having at least two panels the first of which is the front panel and the last of which is the back panel, each of said panels being substantially rectangular, none of said panels being smaller than each said leaf, said jacket having at least one spine, said spines comprising the contiguous area between adjacent panels;

c) means for affixing said road-map holder to the interior side of said jacket in such a manner that the leaves of said road-map holder may be turned like pages in a book.

4. An organizer, comprising:

a) the enclosed road-map holder as recited in claim 3;

b) a first auxiliary pocket, said first auxiliary pocket attached to the interior side of said front panel, said first auxiliary pocket having exactly one opening, said opening being adjacent to a one of said spines;

c) a second auxiliary pocket, said second auxiliary pocket attached to the interior side of said back panel, said second auxiliary pocket having exactly one opening, said opening being adjacent to a one of said spines.

5. The organizer as recited in claim 4, wherein said panels comprise exactly two panels, namely: said front panel and said back panel.

6. The organizer as recited in claim 5, further comprising two half-size, transparent pockets both of which are affixed to an exterior side of said first auxiliary pocket.

7. The organizer as recited in claim 4, wherein said panels comprise exactly three panels, namely: said front panel, a middle panel and said back panel.

8. The organizer as recited in claim 7, further comprising two half-size, transparent pockets both of which are affixed to the middle panel of said jacket.

9. The enclosed road-map holder, as recited in claim 3, wherein said means of affixing said road-map holder to the interior side of said jacket comprises affixing the pivot axis of said road-map holder directly to a spine of said jacket by means of sealing, sewing, fusing, welding, bonding, or gluing, whereby said pivot axis is affixed longitudinally within said spine.

10. The road-map holder as recited in claim 1, further comprising a flap, said flap welded to said road-map holder along said pivot axis.

11. The organizer as recited in claim 4, further comprising a flap, said flap welded to said road-map holder along said pivot axis, wherein said means of affixing said road-map holder to the interior side of said jacket comprises inserting the flap of said road-map holder into either of said auxiliary pockets.

12. The road-map holder as recited in claim 1, wherein the leaves and transparent pockets of said road-map holder are made of materials which are supple.

13. The organizer as recited in claim 4, wherein the panels, spines, and auxiliary pockets of said organizer are made of materials which are supple.

* * * * *